US011422508B2

(12) United States Patent
Hu et al.

(10) Patent No.: US 11,422,508 B2
(45) Date of Patent: Aug. 23, 2022

(54) WEARABLE DEVICE, STRAP AND ENGAGING MECHANISM

(71) Applicant: GUANGDONG OPPO MOBILE TELECOMMUNICATIONS CORP., LTD., Guangdong (CN)

(72) Inventors: Jianghua Hu, Guangdong (CN); Yuege Xue, Guangdong (CN)

(73) Assignee: GUANGDONG OPPO MOBILE TELECOMMUNICATIONS CORP., LTD., Guangdong (CN)

( * ) Notice: Subject to any disclaimer, the term of this patent is extended or adjusted under 35 U.S.C. 154(b) by 172 days.

(21) Appl. No.: 16/900,937

(22) Filed: Jun. 14, 2020

(65) Prior Publication Data

US 2020/0393797 A1 Dec. 17, 2020

(30) Foreign Application Priority Data

Jun. 14, 2019 (CN) ..... 201920909837.6

(51) Int. Cl.
*G04B 37/14* (2006.01)
*A44C 5/14* (2006.01)

(52) U.S. Cl.
CPC ..... *G04B 37/1493* (2013.01); *A44C 5/14* (2013.01)

(58) Field of Classification Search
CPC ..... A44C 5/14; A44C 5/147; A44C 5/2061; A44C 5/2066; G04B 37/1493; G04B 37/1486
See application file for complete search history.

(56) References Cited

U.S. PATENT DOCUMENTS 2,807,855 A 10/1957 Rodriguez
3,824,783 A * 7/1974 Nadeau ..... G04B 37/1493 368/282

(Continued)

FOREIGN PATENT DOCUMENTS

CN 205456580 8/2016
CN 108041775 5/2018

(Continued)

OTHER PUBLICATIONS

ISA/CN, International Search Report for International Application No. PCT/CN2020/095926, dated Sep. 15, 2020.

(Continued)

*Primary Examiner* — Robert Sandy
*Assistant Examiner* — Louis A Mercado
(74) *Attorney, Agent, or Firm* — Hodgson Russ LLP

(57) ABSTRACT

The present application relates to a wearable device, a strap, and an engaging mechanism. The wearable device includes a watch body and a strap. The strap includes a strap body, a peg, a eject pin, and a linkage component. The strap body is provided with a receiving space, and the strap body is provided with a peg-sliding hole and a first through hole. One end of the peg passes through a peg-sliding hole and the other end is located in a receiving space of a watch body; the eject pin is located in the receiving space and can pass through the first through hole; the peg is configured to drive the eject pin to pop out from the first through hole via the linkage component and engage with the installation groove; the peg is further configured to drive the eject pin to move towards the receiving space.

14 Claims, 4 Drawing Sheets

(56) References Cited

U.S. PATENT DOCUMENTS

| | | | | |
|---|---|---|---|---|
| 4,564,308 | A * | 1/1986 | Ikegami | A44C 5/14 224/164 |
| 5,483,505 | A * | 1/1996 | Cartier | G04B 37/1493 368/282 |
| 6,014,793 | A * | 1/2000 | Howald | A44C 5/147 24/115 G |
| 8,240,011 | B2 * | 8/2012 | Chevrolet | A44C 5/14 24/265 B |
| 10,528,006 | B2 * | 1/2020 | Park | A44C 5/14 |
| 10,568,220 | B2 * | 2/2020 | Wu | H05K 5/0221 |
| 10,874,023 | B2 * | 12/2020 | Wu | H05K 7/1489 |
| 11,019,889 | B2 * | 6/2021 | Nicolas | G04B 37/1486 |
| 2007/0070823 | A1 * | 3/2007 | Sima | A44C 5/14 368/282 |
| 2019/0094809 | A1 | 3/2019 | Park et al. | |

FOREIGN PATENT DOCUMENTS

| | | |
|---|---|---|
| CN | 207590171 | 7/2018 |
| CN | 207653709 | 7/2018 |
| CN | 108685288 | 10/2018 |
| CN | 109744666 | 5/2019 |
| CN | 210672331 | 6/2020 |
| EP | 3213654 | 9/2017 |
| EP | 3480665 | 5/2019 |
| WO | 2013140080 | 9/2013 |

OTHER PUBLICATIONS

ISA/CN, Written Opinion of ISA for International Application No. PCT/CN2020/095926, dated Sep. 15, 2020.

EPO, European Search Report for EP Application No. 20179801, dated Oct. 13, 2020.

IPO, Examination Report issued for IN Application No. 202014024925, dated Jan. 11, 2021.

* cited by examiner

WEARABLE DEVICE, STRAP AND ENGAGING MECHANISM

CROSS-REFERENCE TO RELATED APPLICATION

This application claims priority to Chinese Patent Application No. 201920909837.6, filed on Jun. 14, 2019, the entire disclosure of which is incorporated herein by reference.

TECHNICAL FIELD

The present application relates to the technical field of wearable devices.

BACKGROUND

A watch generally includes a strap and a watch body. The strap is attached to lugs of the watch body via spring bars. The spring bars are relatively thin, which makes the attachment or detachment of the strap with the watch body inconvenient.

SUMMARY

According to a first aspect of the present disclosure, there is provided a wearable device to address the problem that the attachment or detachment of the strap with the watch body is inconvenient.

A wearable device includes:

a watch body provided with an installation groove;

a strap configured to be installed in or detached from the installation groove, and the strap includes:

a strap body, wherein one end of the strap body is provided with a receiving space, the strap body is provided with a peg-sliding hole, and the peg-sliding hole communicates with the receiving space and extends to a surface of the strap body; the strap body is provided with a first through hole, and the first through hole communicates with the receiving space and extends to a surface of the strap body;

a peg, wherein one end of the peg penetrates through the peg-sliding hole and is exposed outside the strap body, and the other end of the peg is located in the receiving space;

an eject pin located in the receiving space and configured to penetrate through the first through hole and protrude from the strap body;

a linkage component connected between the peg and the eject pin, wherein the peg is configured to drive the eject pin to pop out from the first through hole via the linkage component and engage with the installation groove so that the strap is installed in the watch body; wherein the peg is configured to drive the eject pin to move towards the receiving space via the linkage component to detach the strap from the installation groove.

In the above-mentioned wearable device, the peg is exposed outside the strap body, and is connected to the eject pin via the linkage component. When the peg moves, the eject pin can be driven to protrude out or retract back to the strap body, so that the watch strap can be installed on the watch body or can be detached from the watch body. The above structure is relatively simple, and it is convenient for a user to apply force, and thus it is possible to avoid operation on thin spring bars. In this way, the convenience in operation is improved, and it is easy to attach the strap to the watch body or detach the strap from the watch body. In addition, the watch body is not provided with protruding lugs for connecting the watch strap, but the installation groove is used to enable the strap to move into the watch body, reducing the gap between the strap and the watch body and improving the appearance of the wearable device.

According to an embodiment, the installation groove includes a receiving groove and an installation hole, and the installation hole is provided in a groove wall of the receiving groove and communicates with the receiving groove; when the strap is installed in the installation groove, one end of the strap provided with the receiving space is accommodated in the receiving groove, the eject pin penetrates through the first through hole and is inserted into the installation hole to connect the strap with the watch body, and the eject pin is configured to retract from the installation hole so that the strap is detached from the watch body.

According to an embodiment, the linkage component includes a first sheet, a second sheet, and a fixing sheet; one end of the first sheet is provided with a second through hole, one end of the second sheet is provided with a third through hole, the peg penetrates through and is fixed to the second through hole and the third through hole, and the first sheet and the second sheet rotate around the peg.

According to an embodiment, there are two eject pins, each of the two eject pins includes an insertion pin and a connector, the connector is located at an end of the insertion pin and is perpendicular to the insertion pin, and in a state where the strap is installed onto the watch body, the insertion pin passes through the first through hole and is inserted into the installation hole.

According to an embodiment, another end of the first sheet is provided with a fourth through hole, and another end of the second sheet is provided with a fifth through hole; the fixing sheet is provided with a first slot and a second slot; a connector of one of the two eject pins penetrates through the first slot and is fixed to the fourth through hole, and a connector of the other one of the two eject pins penetrates through the second slot and is fixed to the fifth through hole.

According to an embodiment, a spring is provided between the connectors of the two eject pins, and the spring drives the insertion pin to protrude from the first through hole.

According to an embodiment, the strap includes an inner surface and an outer surface opposite to each other, and a side peripheral surface connected between the inner surface and the outer surface; the peg-sliding hole extends to the outer surface, and the peg-sliding hole is a strip-shaped hole and is arranged along a length direction of the strap; the first through hole is provided along a width direction of the strap and extends to the side peripheral surface; when the peg moves away from the watch body in the peg-sliding hole, the eject pins retract and are disengaged from the installation hole, and the strap is detached from the watch body; when the peg is in a natural state, each of the eject pins are inserted into a respective installation hole under an action of the spring, and drives the peg to move to an end of the peg-sliding hole close to an end of the watch body.

According to a second aspect of the present disclosure, there is provided a strap to address the problem that the attachment or detachment of the strap with the watch body is inconvenient.

A strap, includes:

a strap body, wherein one end of the strap body is provided with a receiving space, the strap body is provided with a peg-sliding hole, and the peg-sliding hole communicates with the receiving space and extends to a surface of the strap body; the strap body is provided with a first through hole, and the first through hole communicates with the receiving space and extends to a surface of the strap body;

a peg, wherein one end of the peg penetrates through the peg-sliding hole and is exposed outside the strap body, and the other end of the peg is located in the receiving space;

an eject pin located in the receiving space and movably penetrating through the first through hole so as to protrude or retract with respect to the strap body;

a linkage component connected between the peg and the eject pin, wherein when the peg moves at the peg-sliding hole, the peg drives the eject pin to protrude or retract with respect to the strap body via the linkage component, so as to make the eject pin selectively protrude out of the strap body or retract into the strap body.

In the strap, the peg is exposed outside the strap body, and is connected to the eject pin via the linkage component. When the peg moves, the eject pin can be driven to protrude out or retract back to the strap body, so that the watch strap can be easily installed on or detached from the watch body. The above structure is relatively simple, and it is convenient for a user to apply force, and thus it is possible to avoid operation on thin spring bars. In this way, the convenience in operation is improved, and it is easy to attach the strap to the watch body or detach the strap from the watch body.

According to an embodiment, the linkage component includes a first sheet, a second sheet, and a fixing sheet; one end of the first sheet is provided with a second through hole, one end of the second sheet is provided with a third through hole, the peg penetrates through and is fixed to the second through hole and the third through hole, and the first sheet and the second sheet rotate around the peg.

According to an embodiment, there are two eject pins, each of the two eject pins includes an insertion pin and a connector, the connector is located at an end of the insertion pin and is perpendicular to the insertion pin, and the insertion pin is configured to protrude out via the first through hole.

According to an embodiment, another end of the first sheet is provided with a fourth through hole, and another end of the second sheet is provided with a fifth through hole; the fixing sheet is provided with a first slot and a second slot; a connector of one of the two eject pins penetrates through the first slot and is fixed to the fourth through hole, and a connector of the other one of the two eject pins penetrates through the second slot and is fixed to the fifth through hole.

According to an embodiment, a spring is provided between the connectors of the two eject pins, and the spring drives the insertion pin to protrude from the first through hole.

According to an embodiment, the strap includes an inner surface and an outer surface opposite to each other, and a side peripheral surface connected between the inner surface and the outer surface; the peg-sliding hole extends to the outer surface, and the peg-sliding hole is a strip-shaped hole and is arranged along a length direction of the strap; the first through hole is provided along a width direction of the strap and extends to the side peripheral surface; when the peg moves in the peg-sliding hole away from the end of the watch body, the eject pins retract into the strap body; when the peg is in a natural state, each of the eject pins protrudes out via the first through hole under an action of the spring, and drives the peg to move to an end of the peg-sliding hole close to an end of the strap body.

According to a third aspect of the present disclosure, there is provided an engaging mechanism to address the problem that the attachment or detachment of the strap with the watch body is inconvenient.

An engaging mechanism, includes:

a peg;

two eject pins; and a linkage component connected between the peg and the eject pins, wherein when the peg moves, the two eject pins are driven to protrude or retract via the linkage component, and movement directions of the two eject pins are opposite.

In the engaging mechanism, the peg is connected to the eject pins via the linkage component. When the peg moves, the eject pins can be driven to protrude out or retract back to the strap body, so that the watch strap can be easily installed on or detached from the watch body. The above structure is relatively simple, and it is convenient for a user to apply force, and thus it is possible to avoid operation on thin spring bars. In this way, the convenience in operation is improved, and it is easy to attach the strap to the watch body or detach the strap from the watch body.

According to an embodiment, the linkage component includes a first sheet, a second sheet, and a fixing sheet; one end of the first sheet is provided with a second through hole, one end of the second sheet is provided with a third through hole, the peg penetrates through and is fixed to the second through hole and the third through hole, and the first sheet and the second sheet rotate around the peg.

According to an embodiment, another end of the first sheet is provided with a fourth through hole, and another end of the second sheet is provided with a fifth through hole; the fixing sheet is provided with a first slot and a second slot; each of the two eject pins includes an insertion pin and a connector, and the connector is located at an end of the insertion pin and is perpendicular to the insertion pin; the connector of one of the two eject pins penetrates through the first slot and is fixed to the fourth through hole, and a connector of the other one of the two eject pins penetrates through the second slot and is fixed to the fifth through hole.

According to an embodiment, a spring is provided between the connectors of the two eject pins, and the spring is configured to drive the insertion pins to move oppositely

BRIEF DESCRIPTION OF THE DRAWINGS

In order to explain the technical solutions in the embodiments of the present disclosure or the prior art more clearly, the drawings used in the description of the embodiments or the prior art are briefly introduced below. Obviously, the drawings in the following description are merely some embodiments of the present disclosure. For those of ordinary skill in the art, other drawings can be obtained according to these drawings.

DETAILED DESCRIPTION

In order to facilitate understanding of the present disclosure, the present disclosure will be described more fully with reference to the drawings. The drawings show the exemplary embodiments of the present disclosure. However, the present disclosure can be implemented in many different forms and is not limited to the embodiments described herein. Rather, these embodiments are provided to provide a thorough and comprehensive understanding of the disclosure.

Figure 1:
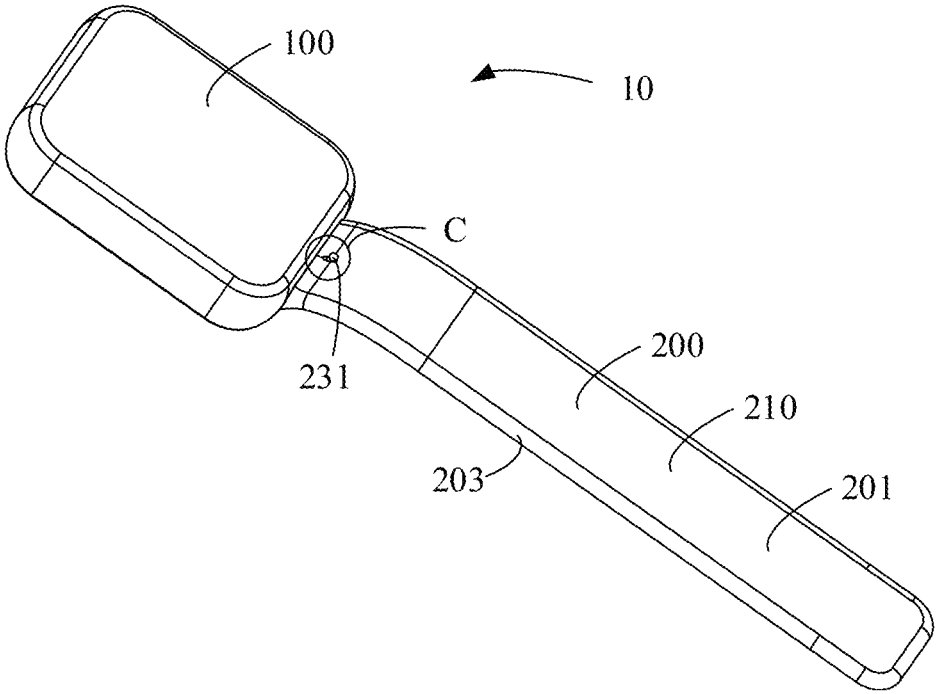
FIG. 1 is a perspective view of a wearable device according to an embodiment.
Figure 2:
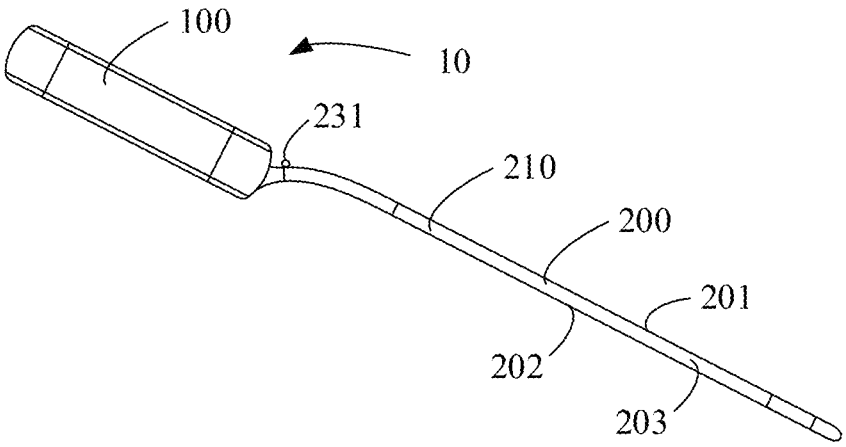
FIG. 2 is a side view of the wearable device shown in FIG. 1.

Referring to FIGS. 1 and 2, in embodiments, the wearable device 10 includes a watch body 100 and a strap 200. The watch body 100 may be made of non-metal materials such as plastic, rubber, silicone, wood or ceramic, and the watch body 100 may be made of metal materials such as stainless steel, aluminum alloy, or magnesium alloy. The inside of the watch body 100 forms an installation space. In some embodiments, the wearable device 10 is a smart wearable device, and the installation space can be used to install electronic components such as a battery, a processor, a display screen, and a biosensor. The display screen is not necessary and can be omitted. The biosensor can be used to detect biological data such as heart rate, respiration rate, blood pressure, or body fat, and so on. In some embodiments, the biosensor can also be used to detect the state of movement, such as for step counting. In other embodiments, the wearable device 10 may be a sports wearable device or a conventional wearable device. A common form of the sports wearable device is an electronic watch, and a common form of the conventional wearable device is a mechanical watch. In other embodiments, the wearable device 10 may also be a smart bracelet or the like.

Figure 4:
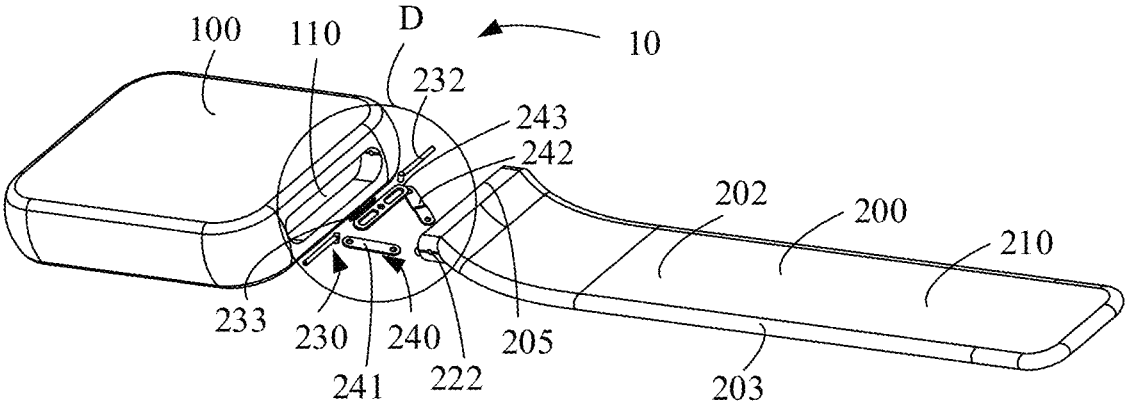
FIG. 4 is an exploded view of the wearable device shown in FIG. 1.

Referring to FIGS. 1 and 4, in embodiments, the watch body 100 is provided with an installation groove 110 for installation of the strap 200. The strap 200 can be fixed to the watch body 100 and can be detached from the watch body 100. In some embodiments, the strap 200 is divided into two sections, and one end of each of the two sections of the strap 200 is connected to the watch body 100. End of the two sections of the strap 200, which are farther from the watch body 100, can be engaged with each other to form a receiving space, so that the wearable device 10 is worn through the strap 200 to the user's wrist or forearm or other parts of the body. In other embodiments, the strap 200 may be a one-piece structure. Two ends of the strap 200 are connected to the watch body 100. The strap 200 may adjust a size of the receiving space through other structures to facilitate user to wear the watch. Embodiments of the present disclosure will be described taking one of the two sections of the two-section strap 200 as an example, but it can be understood that the structures disclosed herein can also applicable to other forms of strap 200.

Figure 5:
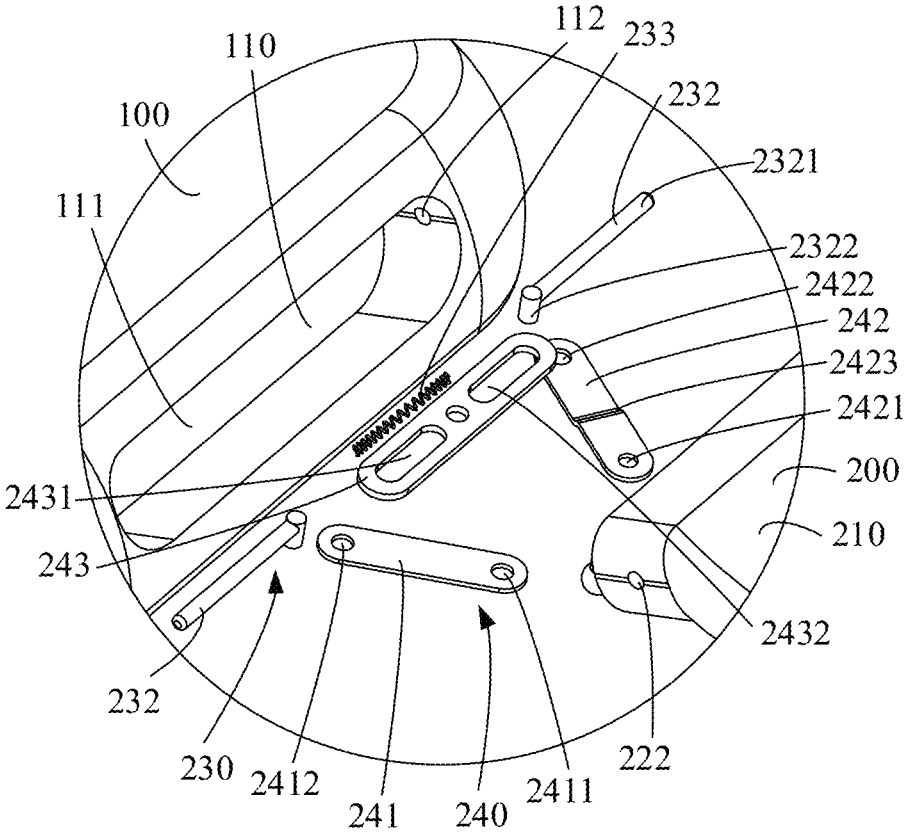
FIG. 5 is an enlarged schematic view of a structure of Part D of the wearable device shown in FIG. 4.

Referring to FIGS. 4 and 5, in embodiments, the wearable device 10 has a length direction, a width direction, and a thickness direction. A direction along which the strap 200 can be flattened is the length direction of the wearable device 10, a width direction of the strap 200 is the width direction of the wearable device 10, and a thickness direction of the strap 200 is the thickness direction of the wearable device 10. The installation groove 110 of the watch body 100 extends to a side surface of the watch body 100. The installation groove 110 includes a receiving groove 111 and a installation hole 112. The receiving groove 111 extends to the side surface of the watch body 100, and the installation hole 112 is provided in a groove wall of the receiving groove 111 and communicates with the receiving groove 111. The installation hole 112 extends in the width direction of the wearable device 10.

Figure 3:
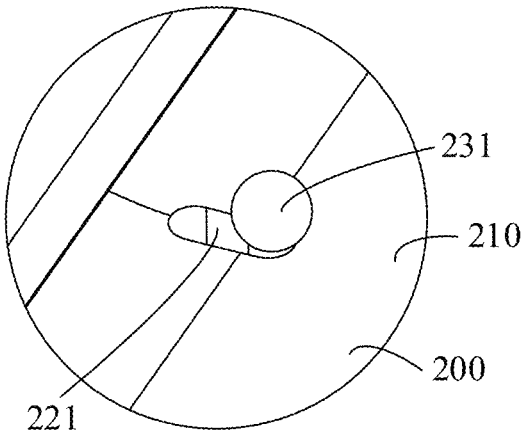
FIG. 3 is an enlarged schematic view of a structure of Part C of the wearable device shown in FIG. 1.

Referring to FIG. 3 to FIG. 5, in embodiments, the strap 200 includes a strap body 210 and an engaging mechanism 230. The strap body 210 is shaped in a long band or strip, and the length direction in which the strap body 210 can be flattened is the length direction of the wearable device 10. Materials of the strap body 210 may be leather, plastic, silicone, rubber, metal, or the like. One end 205 of the strap body 210 is provided with a receiving space 220 (shown in FIG. 7), and the engaging mechanism 230 is located in the receiving space 220. The strap 200 includes an inner surface 202 and an outer surface 201 opposite to each other, and a side peripheral surface 203 connected between the inner surface 202 and the outer surface 201. When a user wears the wearable device 10 normally, a side of the strap 200 that contacts the user's skin is defined as the inner surface 202 of the strap 200, and a side of the strap 200 opposite the inner surface 202 is defined as the outer surface 201 of the strap 200. The strap body 210 is provided with a peg-sliding hole 221, which communicates with the receiving space 220 and extends to the outer surface 201 of the strap body 210. The strap body 210 is provided with a first through hole 222, which communicates with the receiving space 220 and extends to the surface of the strap body 210. In one embodiment, the peg-sliding hole 221 is a strip-shaped hole, which can extend along the length direction of the strap body 210 (i.e., the length direction of the wearable device 10). A hole depth of the peg-sliding hole 221 is defined along the thickness direction of the strap body 210, that is, the thickness direction of the wearable device 10, and one end of the peg-sliding hole 221 extends to communicate with the receiving space 220, and the other end extends to the outer surface 201 of the strap body 210. The peg-sliding hole 221 is a hole or opening which a peg 231 (shown in FIG. 3) can slide in. The first through hole 222 extends along the width direction of the strap body 210, that is, the width direction of the wearable device 10, and one end first through hole 222 extends to communicate with the receiving space 220, and the other end first through hole 222 extends to the side peripheral surface 203 of the strap body 210.

Figure 6:
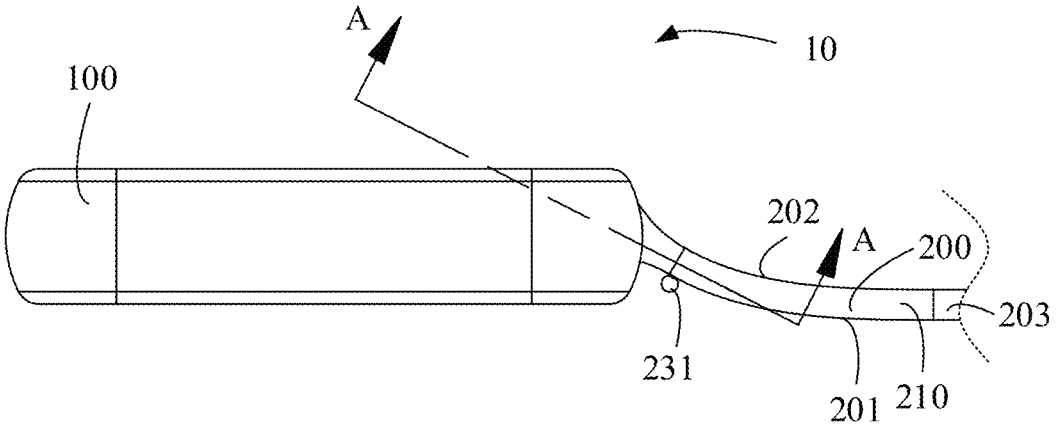
FIG. 6 is a partial side view of the wearable device shown in FIG. 1.
Figure 7:
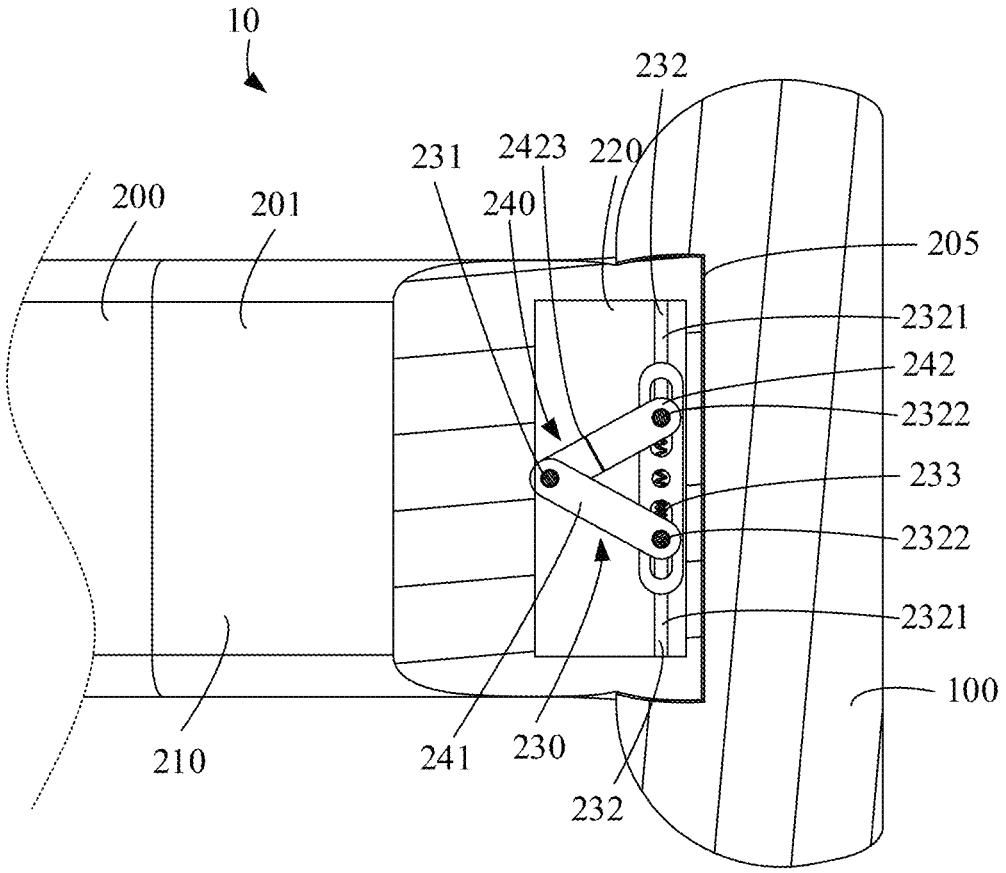
FIG. 7 is a cross-sectional view of the wearable device shown in FIG. 6 taken along A-A line.

As shown in FIG. 5 to FIG. 7, the engaging mechanism 230 is installed in the receiving space 220 and includes a peg 231, eject pins 232, and a linkage component 240. The linkage component 240 is located in the receiving space 220.

The peg 231 penetrates through the peg-sliding hole 221, one end of the peg 231 is exposed outside the strap body 210, and the other end of the peg 231 is connected to the linkage component 240 located in an installation space. The peg 231 can move in the peg-sliding hole 221 to approach the watch body 100 or go away from the watch body 100. According to some embodiments, the peg 231 may be a piece of cylindrical or tapered pin. The pin can be extended along the thickness direction of the strap. According to some other embodiments, the peg 231 may be a small piece of pin having a round head. For example, the end of the peg 231 having the round head is exposed outside the surface of the strap, and the other end of the peg 231 is connected to the linkage component 240. The round-head-shaped peg 231 is convenient for a user to move the peg 231 and can protect the user from damage due to a sharp tip of the peg 231.

One end of one of eject pins 232 is connected to the linkage component 240, and the other end of one of eject pins 232 passes through the first through hole 222, and can move through the first through hole 222 to extend out or retract into the strap body 210. When the peg 231 is moved, the peg 231 can drive the eject pins 232 to protrude or retract via the linkage component 240. In an embodiment, the number of the eject pins 232 is two, and the two eject pins 232 are oppositely arranged. When the peg 231 is moved, the peg 231 can drive the two eject pins 232 to move in opposite directions via the linkage component 240. When the peg 231 drives two eject pins 232 to retract into the strap body 210 via the linkage component 240, the strap 200 can be inserted into the receiving groove 111, and the first through hole 222 communicates with the installation hole 112; when the peg 231 drives the two eject pins 232 to extend out of the strap body 210 via the linkage component 240, the two eject pins 232 enter two oppositely disposed installation holes 112, respectively (for example, the two eject pins 232 snap into corresponding installation holes 112), so that the strap 200 is installed on the watch body 100. When the peg 231 drives the two eject pins 232 to be disengaged from the installation holes 112 and retract into the strap body 210 via the linkage component 240, the strap 200 can be detached from the watch body 100.

It should be noted that the number of the eject pins 232 may also be three or more, as long as the eject pins 232 are adaptively connected to the linkage component 240, and the eject pins 232 can cooperate with the corresponding installation holes 112 in the installation groove 110 of the watch body 100 under the linkage action of the linkage component 240.

In embodiments, one of the eject pins 232 includes an insertion pin 2321 and a connector 2322. The connector 2322 is located at an end of the insertion pin 2321 and is perpendicular to the insertion pin 2321. In the state where the strap 200 is installed onto the watch body 100, the insertion pin 2321 passes through the first through hole 222 and is inserted into the installation hole 112.

With continued reference to FIGS. 5 to 7, in embodiments, the linkage component 240 includes a first sheet 241, a second sheet 242, and a fixing sheet 243. The fixing sheet 243 is a strip-shaped metal sheet, and is arranged along the width direction of the strap body 210, that is, the width direction of the wearable device 10. The fixing sheet 243 is provided with a first slot 2431 and a second slot 2432. The first slot 2431 and the second slot 2432 are shaped like a track and extend along the width direction of the strap body 210. The first sheet 241 is a strip-shaped metal sheet. One end of the first sheet 241 is provided with a second through hole 2411 and the other end is provided with a fourth through hole 2412. The first sheet 241 is arranged obliquely in the receiving space 220. One end of the first sheet 241 is connected to the peg 231 through the second through hole 2411, and the other end is connected to the first slot 2431 through the fourth through hole 2412. The peg 231 passes through the second through hole 2411. The first sheet 241 can be rotated using the peg 231 as a rotation axis. A connector 2322 of the eject pin 232 passes through the first slot 2431 and is connected to the fourth through hole 2412. The first sheet 241 can be rotated by using the connector 2322 as a rotation axis. The connector 2322 can move along the first slot 2431, to make the insertion pin 2321 extend out of the strap body 210 or retract into the strap body 210, and meanwhile, one end of the first sheet 241 rotates around the peg 231 through the second through hole 2411, and the other end rotates around the connector 2322 through the fourth through hole 2412. In another embodiment, the fourth through hole 2412 and the connector 2322 may be connected by a rivet or a dowel which passes through the first slot 2431, and the rivet or the dowel can move along the first slot 2431, so that one end of the first sheet 241 is rotated around the peg 231 through the second through hole 2411, and the other end is rotated around the rivet or the dowel through the fourth through hole 2412.

The second sheet 242 is a strip-shaped metal sheet. One end of the second sheet 242 is provided with a third through hole 2421 and the other end is provided with a fifth through hole 2422. The second sheet 242 is arranged obliquely in the receiving space 220. One end is connected to the peg 231 through the third through hole 2421, and the other end is connected to the second slot 2432 through the fifth through hole 2422. The end of the second sheet 242 is stacked with the end of the first sheet 241, so that the third through hole 2421 communicates with the second through hole 2411, and the peg 231 passes through both the third through hole 2421 and the second through hole 2411. The second sheet 242 can be rotated by using the peg 231 as a rotation axis. The fifth through hole 2422 and the second sliding slot 2432 are connected through the connector 2322 of another eject pin 232. The end of the connector 2322 is connected to the fifth through hole 2422, and the second sheet 242 can be rotated by using the connecting head 2322 as a rotation axis. The connector 2322 can move along the second slot 2432, to make the insertion pin 2321 extend out of the strap body 210 or retracts into the strap body 210, and meanwhile, one end of the second sheet 242 rotates around the peg 231 through the third through hole 2421 and the other end rotates around the second rivet through the fifth through hole 2422. In another embodiment, the fifth through hole 2422 and the connector 2322 can be connected by a rivet or a dowel which passes through the second slot 2432, and the rivet or the dowel can move along the second slot 2432, so that one end of the second sheet 242 is rotated around the peg 231 through the third through hole 2421, and the other end is rotated around the rivet or the dowel through the fifth through hole 2422.

In an embodiment, a step 2423 is provided on the second sheet 242, so that an end of the second sheet 242 provided with the third through hole 2421 is stacked below an end of the first sheet 242 provided with the second through hole 2311, that is, the second through hole 2411 is located between the third through hole 2421 and the peg-sliding hole 221. An end of the second sheet 242 provided with the fifth through hole 2422 and an end of the first sheet 241 provided with the fourth through hole 2412 are located on the fixing sheet 243. The setting of the step 2423 of the second sheet 242 enables the above-mentioned connection manner of the first sheet 241, the second sheet 242, and the fixing sheet 243 to be realized. It can be understood that the setting of the step 2423 needs to meet the requirement that the first sheet 241 and the second sheet 242 can move without interference. It can be understood that the materials of the fixing sheet 243, the first sheet 241, and the second sheet 242 can be non-metallic materials.

As shown in FIG. 7, when the peg 231 moves in the peg-sliding hole 221 towards a direction away from one end 205 of the strap body 210, the first sheet 241 and the second sheet 242 both rotate around the peg 231 to move towards each other, so that the included angle between the first sheet 241 and the second sheet 242 is reduced, and the connectors 2322 of the two eject pins 232 move toward each other along the first slot 2431 and the second slot 2432, and a distance between the two connectors 2322 is reduced. The insertion pins 2321 of the two eject pins 232 are retracted into the strap body 210, and the strap 200 can be inserted into the receiving groove 111 or detached from the receiving groove 111. When the peg 231 moves in the peg-sliding hole 221 towards the end 205 of the strap body 210, both the first sheet 241 and the second sheet 242 rotate around the peg 231 to move away from each other, so that the included angle between the first sheet 241 and the second sheet 242 becomes larger, and the connectors 2322 of the two eject pins 232 move away from each other along the first slot 2431 and the second slot 2432, respectively, and the distance between the two connecters increases. The two insertion pins 2321 of the two eject pins 232 respectively protrude from the two first through holes 222 and can be respectively inserted into two corresponding installation holes 112, so that the strap 200 can be installed on the watch body 100.

As shown in FIG. 5 and FIG. 7, in embodiments, a spring 233 is provided between the two eject pins 232, one end of the eject pin 233 is fixed to a connector 2322 of one of the eject pins 232, and the other end of the spring 233 is fixed to a connector 232 of another eject pin 233. When the peg 231 is toggled to make the peg 231 move away from the end 205 of the strap body 210, the two eject pins 232 move towards each other and retract into the strap body 210, and the spring 233 is compressed. When the force applied to the peg 231 is released, the spring 233 in the compressed state drives the two eject pins 232 to extend out of the strap body 210, and the first sheet 241 and the second sheet 242 rotate as the connectors 2322 move along the first slot 2431 and the second slot 2432, and the included angle between the two increases, driving the peg 231 to move in the peg-sliding hole 221 towards the end 205 of the strap body 210, that is, towards the watch body 100. Until the two insertion pins 2321 are inserted into the installation holes 112 respectively to make the strap 200 installed onto the watch body 100, the peg 231 stops moving in the peg-sliding hole 221 and stays at the end of the peg-sliding hole 221 close to the watch body 100.

In the wearable device 10 of the present disclosure, the peg 231 is exposed outside the strap body 210 and is connected to ends of the first sheet 241 and the second sheet 242. The two eject pins 232 pass through the first slot 2431 and the second slot 2432 of the fixing sheet 243 and are respectively connected to the other ends of the first sheet 241 and the second sheet 242, and a spring 233 is provided between the two eject pins 232. By moving the peg 231, the two eject pins 232 can be driven to extend out or retract into the strap body 210. In the state where the two eject pins 232 are retracted into the strap body 210, the end 205 of the strap 200 can be placed in the installation groove 110; and when the force on the peg 231 is released, and the two eject pins 232 extend out of the strap body 210 under the action of the spring 233 and snap into the installation groove 110, so that the strap 200 is installed onto the watch body 100. When the peg 231 is moved again to retract the two eject pins 232 into the strap body 210, the strap 200 can be detached from the watch body 100. The above structure is relatively simple and convenient for users to exert force. Therefore, it is possible to avoid the operation of thin spring bars. In this way, the convenience in operation can be improved and the attachment and detachment between the strap 200 and the watch body 100 becomes easy. For example, with the wearable device 10 having the above-mentioned structure, a user can conveniently change different straps 200 of different styles depending on usage scenarios. The watch body 100 is not provided with protruding lugs for connecting the strap 200. Instead, the installation groove 110 is used to allow the strap 200 to be inserted into the watch body 100, thereby reducing the gap between the strap 200 and the watch body 100 and improving the aesthetics of the wearable device 10.

The technical features of the embodiments described above can be arbitrarily combined. In order to simplify the description, the present disclosure does not provide all possible combinations of the technical features in the above embodiments. However, as long as there is no contradiction in the combination of these technical features, such combination should be considered as fall within the scope defined by the present disclosure.

Some example embodiments of the present disclosure are provided above, and details regarding the embodiments are given, but such details cannot be understood as a limitation on the scope of the present disclosure. It should be noted that, for those of ordinary skill in the art, modifications and improvements can be made without departing from the spirit of the present disclosure and all such modifications and improvements should be considered as fall with the protection scope defined by the appended claims.

What is claimed is:

1. A wearable device, comprising:

a watch body provided with an installation groove;

a strap configured to be installed in or detached from the installation groove, and the strap comprising:

a strap body, wherein one end of the strap body is provided with a receiving space, the strap body is provided with a peg-sliding hole, and the peg-sliding hole communicates with the receiving space and extends to a surface of the strap body; the strap body is provided with a first through hole, and the first through hole communicates with the receiving space and extends to a surface of the strap body;

a peg, wherein one end of the peg penetrates through the peg-sliding hole and is exposed outside the strap body, and the other end of the peg is located in the receiving space;

an eject pin located in the receiving space and configured to penetrate through the first through hole and protrude from the strap body; and a linkage component connected between the peg and the eject pin, wherein the peg is configured to drive the eject pin to pop out from the first through hole via the linkage component and engage with the installation groove so that the strap is installed in the watch body; wherein the peg is configured to drive the eject pin to move towards the receiving space via the linkage component so as to detach the strap from the installation groove;

wherein the linkage component comprises a first sheet, a second sheet, and a fixing sheet one end of the first sheet is provided with a second through hole, one end of the second sheet is provided with a third through hole, the peg penetrates through and is fixed to the second through hole and the third through hole, and the first sheet and the second sheet rotate around the peg.

2. The wearable device according to claim 1, wherein the installation groove comprises a receiving groove and an installation hole, and the installation hole is provided in a groove wall of the receiving groove and communicates with the receiving groove; when the strap is installed in the installation groove, one end of the strap provided with the receiving space is accommodated in the receiving groove, the eject pin penetrates through the first through hole and is inserted into the installation hole to connect the strap with the watch body, and the eject pin is configured to retract from the installation hole so that the strap is detached from the watch body.

3. The wearable device according to claim 2, wherein there are two eject pins, each of the two eject pins comprises an insertion pin and a connector, the connector is located at an end of the insertion pin and is perpendicular to the insertion pin, and in a state where the strap is installed onto the watch body, the insertion pin passes through the first through hole and is inserted into the installation hole.

4. The wearable device according to claim 3, wherein another end of the first sheet is provided with a fourth through hole, and another end of the second sheet is provided with a fifth through hole; the fixing sheet is provided with a first slot and a second slot; the connector of one of the two eject pins penetrates through the first slot and is fixed to the fourth through hole, and the connector of the other one of the two eject pins penetrates through the second slot and is fixed to the fifth through hole.

5. The wearable device according to claim 4, wherein a spring is provided between the connectors of the two eject pins, and the spring drives the insertion pin to protrude from the first through hole.

6. The wearable device according to claim 5, wherein the strap comprises an inner surface and an outer surface opposite to each other, and a side peripheral surface connected between the inner surface and the outer surface; the peg-sliding hole extends to the outer surface, and the peg-sliding hole is a strip-shaped hole and is arranged along a length direction of the strap; the first through hole is provided along a width direction of the strap and extends to the side peripheral surface; when the peg moves away from the watch body in the peg-sliding hole, the eject pins retract and are disengaged from the installation hole, and the strap is detached from the watch body; when the peg is in a natural state, each of the eject pins are inserted into a respective installation hole under an action of the spring, and drives the peg to move to an end of the peg-sliding hole close to an end of the watch body.

7. A strap, comprising:

a strap body, wherein one end of the strap body is provided with a receiving space, the strap body is provided with a peg-sliding hole, and the peg-sliding hole communicates with the receiving space and extends to a surface of the strap body; the strap body is provided with a first through hole, and the first through hole communicates with the receiving space and extends to a surface of the strap body;

a peg, wherein one end of the peg penetrates through the peg-sliding hole and is exposed outside the strap body, and the other end of the peg is located in the receiving space;

an eject pin located in the receiving space and movably penetrating through the first through hole so as to protrude or retract with respect to the strap body; and a linkage component connected between the peg and the eject pin, wherein when the peg moves at the peg-sliding hole, the peg drives the eject pin to protrude or retract with respect to the strap body via the linkage component, so as to make the eject pin selectively protrude out of the strap body or retract into the strap body;

wherein the linkage component comprises a first sheet, a second sheet, and a fixing sheet one end of the first sheet is provided with a second through hole, one end of the second sheet is provided with a third through hole, the peg penetrates through and is fixed to the second through hole and the third through hole, and the first sheet and the second sheet rotate around the peg.

8. The strap according to claim 7, wherein there are two eject pins, each of the two eject pins comprises an insertion pin and a connector, the connector is located at an end of the insertion pin and is perpendicular to the insertion pin, and the insertion pin is configured to protrude out via the first through hole.

9. The strap according to claim 8, wherein another end of the first sheet is provided with a fourth through hole, and another end of the second sheet is provided with a fifth through hole; the fixing sheet is provided with a first slot and a second slot; the connector of one of the two eject pins penetrates through the first slot and is fixed to the fourth through hole, and the connector of the other one of the two eject pins penetrates through the second slot and is fixed to the fifth through hole.

10. The strap according to claim 9, wherein a spring is provided between the connectors of the two eject pins, and the spring drives the insertion pin to protrude from the first through hole.

11. The strap according to claim 10, wherein the strap comprises an inner surface and an outer surface opposite to each other, and a side peripheral surface connected between the inner surface and the outer surface; the peg-sliding hole extends to the outer surface, and the peg-sliding hole is a strip-shaped hole and is arranged along a length direction of the strap; the first through hole is provided along a width direction of the strap and extends to the side peripheral surface; when the peg moves in the peg-sliding hole away from an end of a watch body, the eject pins retract into the strap body; when the peg is in a natural state, each of the eject pins protrudes out via the first through hole under an action of the spring, and drives the peg to move to an end of the peg-sliding hole close to an end of the strap body.

12. An engaging mechanism, comprising:

a peg;

two eject pins; and a linkage component connected between the peg and the eject pins, wherein when the peg moves, the two eject pins are driven to protrude or retract via the linkage component, and movement directions of the two eject pins are opposite;

wherein the linkage component comprises a first sheet, a second sheet, and a fixing sheet; one end of the first sheet is provided with a second through hole, one end of the second sheet is provided with a third through hole, the peg penetrates through and is fixed to the second through hole and the third through hole, and the first sheet and the second sheet rotate around the peg.

13. The engaging mechanism according to claim 12, wherein another end of the first sheet is provided with a fourth through hole, and another end of the second sheet is provided with a fifth through hole; the fixing sheet is provided with a first slot and a second slot; each of the two eject pins comprises an insertion pin and a connector, and the connector is located at an end of the insertion pin and is perpendicular to the insertion pin; the connector of one of the two eject pins penetrates through the first slot and is fixed to the fourth through hole, and the connector of the other one of the two eject pins penetrates through the second slot and is fixed to the fifth through hole.

14. The engaging mechanism according to claim 13, wherein a spring is provided between the connectors of the two eject pins, and the spring is configured to drive the insertion pins to move oppositely.

* * * * *